United States Patent [19]

Berger

[11] Patent Number: 4,831,792

[45] **Date of Patent: * May 23, 1989**

[54] RETRACTABLE STADIUM ROOF SYSTEM WITH RECTANGULAR OPENING

[76] Inventor: Horst L. Berger, 18 Chestnut Dr., Hastings-on-Hudson, N.Y. 10706

[ * ] Notice: The portion of the term of this patent subsequent to Jul. 28, 2004 has been disclaimed.

[21] Appl. No.: 76,120

[22] Filed: Jul. 21, 1987

Related U.S. Application Data

[63] Continuation-in-part of Ser. No. 913,520, Sep. 30, 1986, Pat. No. 4,682,449.

[51] Int. Cl.[4] ..... E04B 1/346

[52] U.S. Cl. ..... 52/66; 52/6; 52/83

[58] Field of Search ..... 52/66, 64, 83, 6

[56] References Cited

U.S. PATENT DOCUMENTS

| | | | |
|---|---|---|---|
| 1,347,815 | 7/1920 | Le Cocq | 52/64 |
| 1,566,521 | 12/1925 | Brinton | 52/83 |
| 2,052,217 | 8/1936 | De Sibour | 52/64 |
| 2,126,413 | 8/1938 | Respess | 52/83 |
| 3,552,072 | 1/1971 | O'Connell | 52/64 |
| 3,579,932 | 5/1971 | Atkinson | 52/83 |
| 3,815,299 | 6/1974 | Sorensen | 52/66 |
| 4,175,361 | 11/1979 | Kumode | 52/66 |
| 4,581,860 | 4/1986 | Berger | 52/63 |

FOREIGN PATENT DOCUMENTS

| | | | |
|---|---|---|---|
| 692954 | 10/1979 | U.S.S.R. | 52/83 |

*Primary Examiner*—Henry E. Raduazo

*Attorney, Agent, or Firm*—Cooper & Dunham

[57] ABSTRACT

A structure, such as for a full-size stadium roof, which has a retractable central portion capable of opening up about one-half of the total roof area. Two retractable roof panels, rectangular in plan, cover an area that can be larger than a football field, and move in the direction of the main axis of the stadium.

4 Claims, 11 Drawing Sheets

RETRACTABLE STADIUM ROOF SYSTEM WITH RECTANGULAR OPENING

REFERENCE TO RELATED APPLICATIONS

This is a continuation-in-part of my earlier application Ser. No. 913,520 filed Sept. 30, 1986, to issue on July 28, 1987 as U.S. Pat. No. 4,682,449. The entire disclosure of said earlier application is hereby incorporated by reference in this application.

BACKGROUND AND SUMMARY OF THE INVENTION

The invention is in the field of structures for covering large areas, such as a full size stadium, and is particularly directed to a structure having a retractable roof. A structure having a partially retractable roof is illustrated at FIG. 6 of U.S. Pat. No. 4,581,860, in which the applicant herein is the inventor and which is hereby incorporated by reference. Other large-span structures for enclosing stadium-size spaces are discussed in a presentation of the inventor herein to the International Symposium on Spatial Roof Structures at Dortmund, Germany, Sept. 10, 1984 entitled "A Decade of Fabric Tension Structures for Permanent Buildings," and in the 12 references cited at pages 19 and 20 of the presentation. The presentation and its 12 references are hereby incorporated by reference in this specification.

It is believed that there is an increasing demand for covered full-size stadiums and similar structures to make sports and other events independent of the weather. On the other hand, there is a desire to retain the outdoor character of certain events whenever possible, which leads to the demand for retractable roofs. A major difficulty in designing and building a stadium-size structure with a retractable roof is the combination of size and movable parts. Full-size stadiums require free-span roof areas in the area of several hundred thousand feet, and roofs of this size and span to be economically and practically built and used require special structural techniques. In particular, structures of this type can make use of efficient geometries such as domes, saddles, etc., which have a circular, elliptic, or super elliptic boundary condition. Making the roof, or at least the central part of the roof, retractable generally makes those closed structural shapes difficult to implement, although one implementation of a partially retractable roof is shown in said prior U.S. Pat. No. 4,581,860 of the inventor herein. A further consequence of a retractable design is that the movable sections of the roof have to fit the geometry of the structure both in the open and in the closed positions, and this requirement can tend to dominate the geometry choices. One such requirement can be that the edges of the movable roof panels run on straight lines or circles. A further such requirement can be that the superimposed loads, such as wind and snow, have to be safely supported in the open and closed positions, and preferably in any intermediate state as well. Also, rain water has to run off in any position. The combined difficulty of these and other considerations is underscored by the fact that to the knowledge of the inventor herein no retractable stadium roofs have been built so far.

This invention provides a functional, structurally efficient, and economical solution for a full-size stadium roof which, in one nonlimiting example, has a retractable central portion which can open up approximately one-half of the total roof area. This is achieved by the choice of a unique geometric configuration and a unique combination of structural systems, materials and construction methods.

In one exemplary embodiment a central rectangular opening of the roof is covered by two retractable roof panels which are rectangular in plan and can cover an area substantially larger than a football field. The panels are substantially rigid, using trussed steel construction or similar rigid lightweight framing. They are covered with a structural fabric membrane or other lightweight roofing system, and move in the direction of the main axis of the stadium (in the case of a football or soccer field, the main axis is along the long direction of the field, and in the case of baseball it is a line through home plate and third base). In at least one elevation the roof panels are high in the middle and low at the ends, thus allowing water to run off in any position of the panels. In the direction of the main axis the retractable panels in a first embodiment follow a slight circular curve, to thereby ride on similarly curved tracks supported on track girders. In a second embodiment the retractable panels move along straight, horizontal lines to open and close the roof. Rollers between the panels and the track girders are arranged to resist downloads, uploads (e.g. from wind uplift), and lateral loads. In the first embodiment the movement of the panels is generated by a hoist system similar to that of an elevator or cable car, with cables running along the track girders, which form the inboard edges of two fixed portions of the roof that flank the sides of the stadium field. Two other fixed portions of the roof flank the ends of the stadium field, and are under the curve along which the retractable panels move to their open positions. In the second embodiment the roof panels ride along straight, horizontal girders, on wheels driven by electric motors synchronized as those on electric trains. The track girders are the main longitudinal support members of the roof, running the total length of the stadium. They are suspended from the arches by respective cable systems similar to those used in a stay cable bridge, or by respective rigid struts. The upper support points of these suspension cables or struts are a part of an arch which gathers the loads from all of the cables or struts on one side, spanning over the length of the structure. Each arch in turn is laterally supported by a triangulated set of inclined struts which rest on an edge ring at the stadium perimeter. The edge ring can be horizontal in the first embodiment, and in the second embodiment can be concave in each elevation. Horizontal tie cables can extend between the two track beams to provide continuity of the system, spanning across the opening in the retractable portion of the roof.

An exemplary first embodiment of the invention comprises two tracks which in plan view are parallel to each other and to a first axis of the stadium field, and in elevational view along the first axis are convex and conform an arc of a circle. In a second exemplary embodiment of the invention the two tracks in plan view are parallel to each other and to a first axis of the stadium field, and in elevational view are horizontal. Two arches in plan view are convex and circumscribe the tracks such that each track is along a chord of a respective arch. In elevational view along the first axis the arches are convex and have curvatures greater than those of the tracks in the first embodiment to thereby extend above them. A substantially rigid, laterally extending edge ring in plan view generally follows the outline of the arches and in the first embodiment in elevational views along the first axis extends along chords of the arches and tracks. In the second embodiment the edge ring is concave in each elevation. A support, such as a system of columns, can be used to raise the edge ring above grade. The ends of the arches rest on rigid abutments which carry the arch forces into the foundations. Between these abutments the arches are laterally braced by two respective sets of triangulated, inwardly inclined struts, such as steel struts, which rest on the edge ring. In the second embodiment the arches can be supported in the same way, or the horizontal track girders can serve as tie beams for the arches, thereby doing away with the need for the abutments. The track girders are suspended from the arches by two respective triangulated sets of cables or by rigid struts. Horizontal tie cables can span from one track girder to another, and two respective sets of stabilizing cables or rigid struts can connect the track girders to the edge ring. This system can be prestressed and, together with the track girders, can form a sufficiently rigid support for the tracks. The roof panels form substantially rigid space frames covered with fabric or other lightweight roofing material shaped to drain water laterally onto the rigid, fixed portions of the roof at the sides of the stadium field. In the first embodiment (curved, convex tracks), a system of hoist cables and winches is provided to selectively move the roof panels toward and away from each other along the tracks, to thereby close or open the roof of the structure. In the second embodiment (horizontal tracks) there is no need for such a system, and the roof panels are mounted on and are moved along the tracks by wheels powered by electric motors in a manner similar to that used in electric train cars.

DETAILED DESCRIPTION

Figure 1:
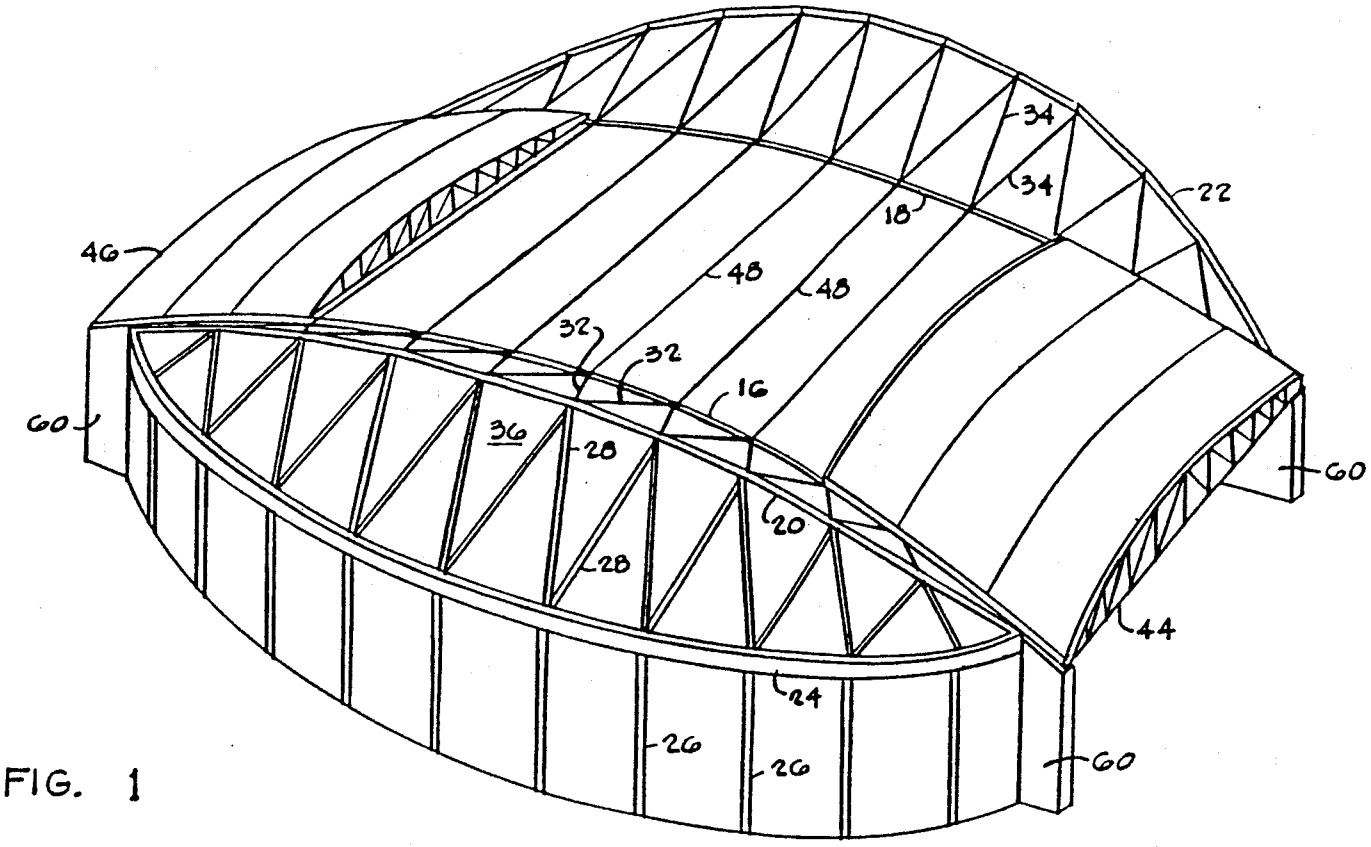
FIG. 1 is a perspective view of a first embodiment of the invention.
Figure 2:
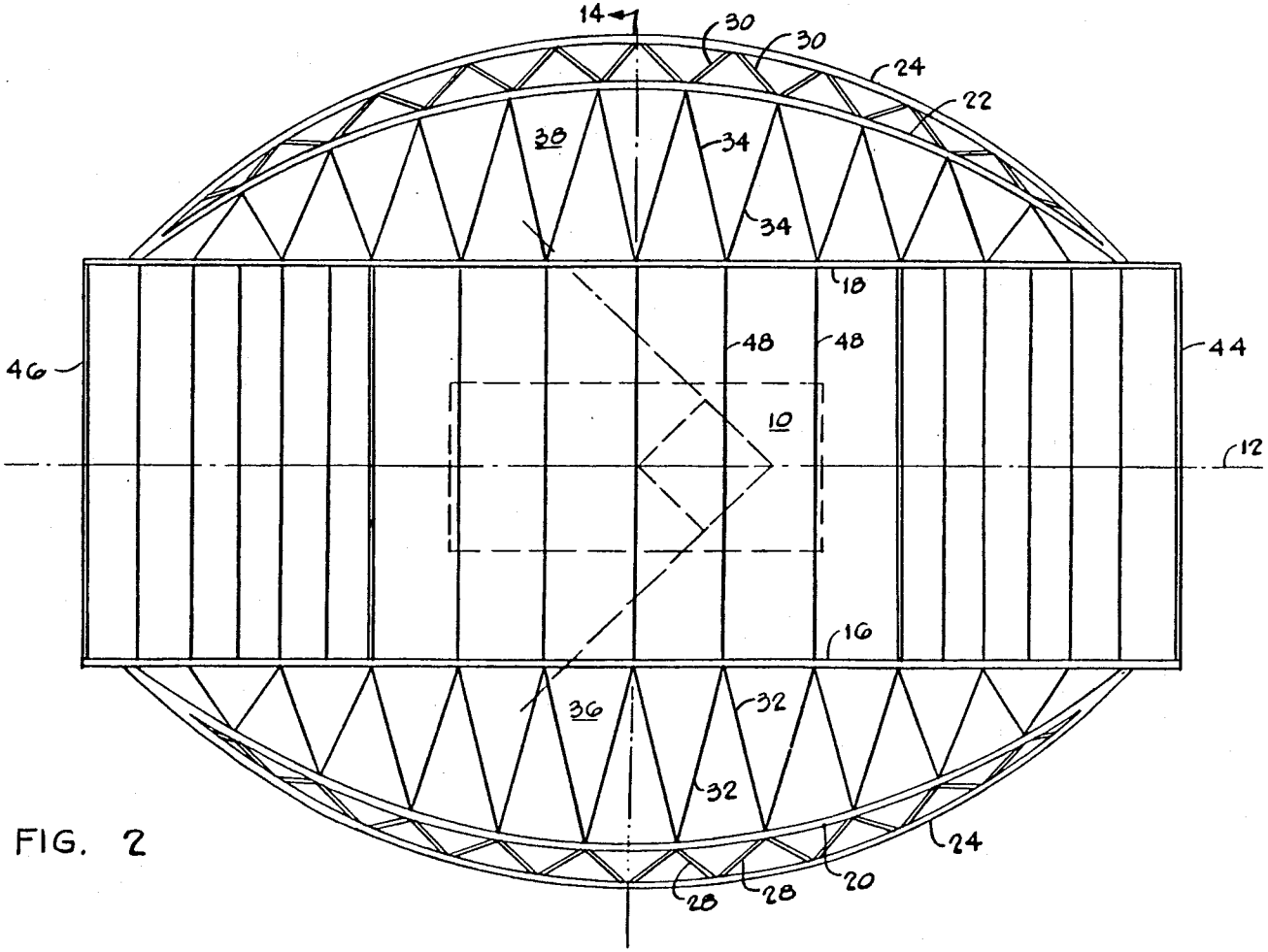
FIG. 2 is a plan view showing retractable roof panels in their open positions.
Figure 3:
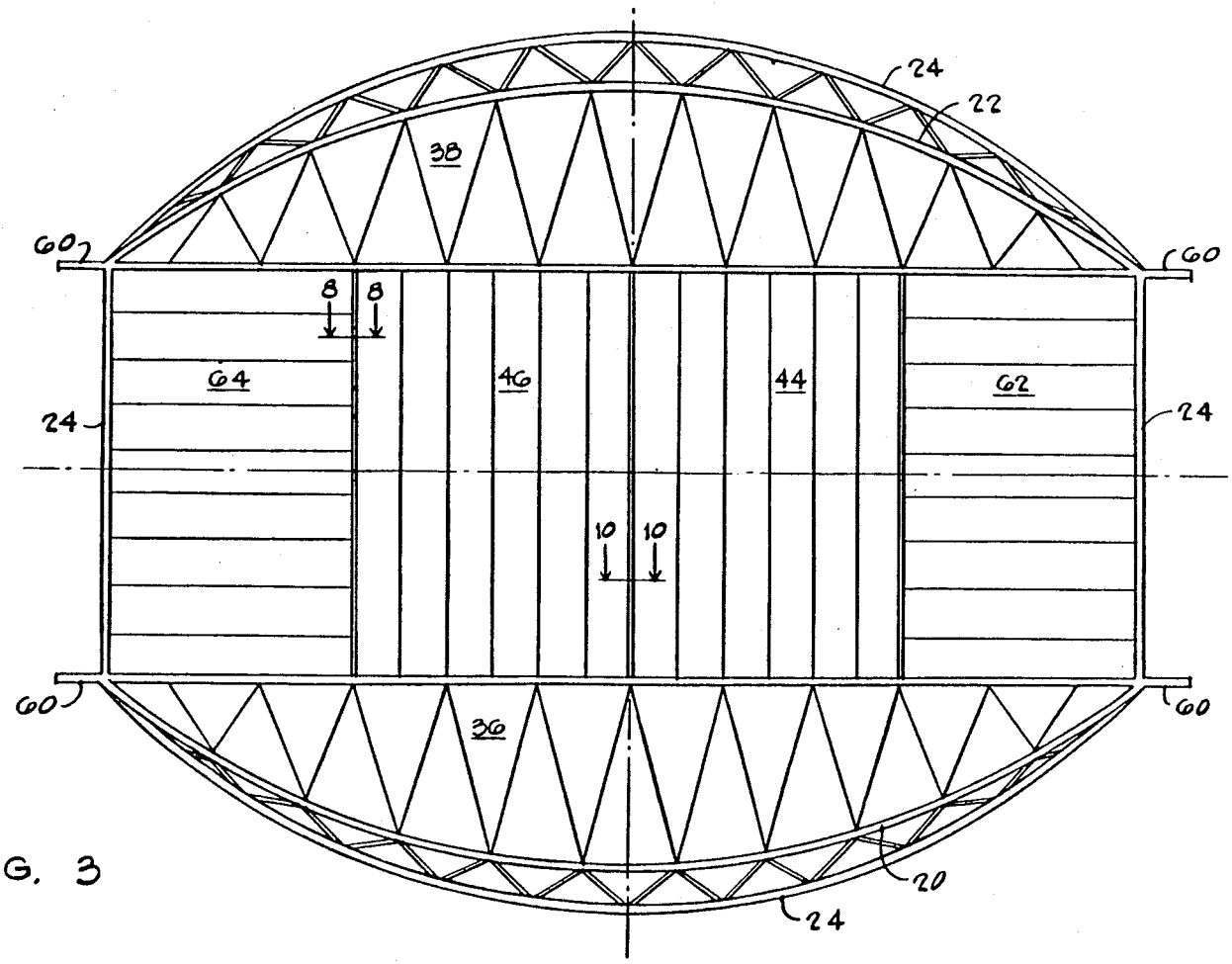
FIG. 3 is a plan view showing the retractable roof panels in their closed positions.
Figure 4:
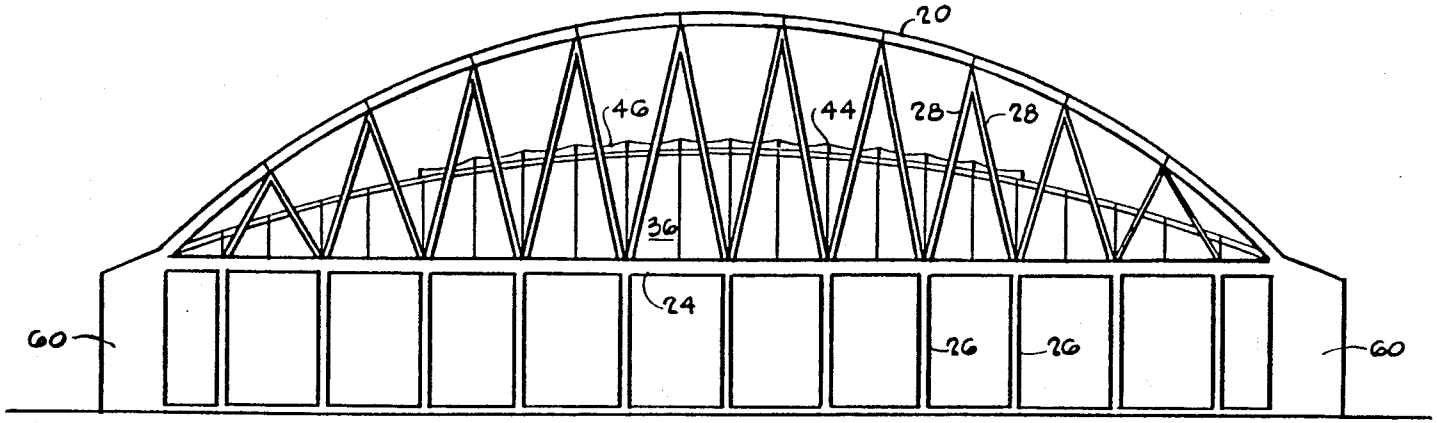
FIG. 4 is an elevational view along a first axis.
Figure 5:
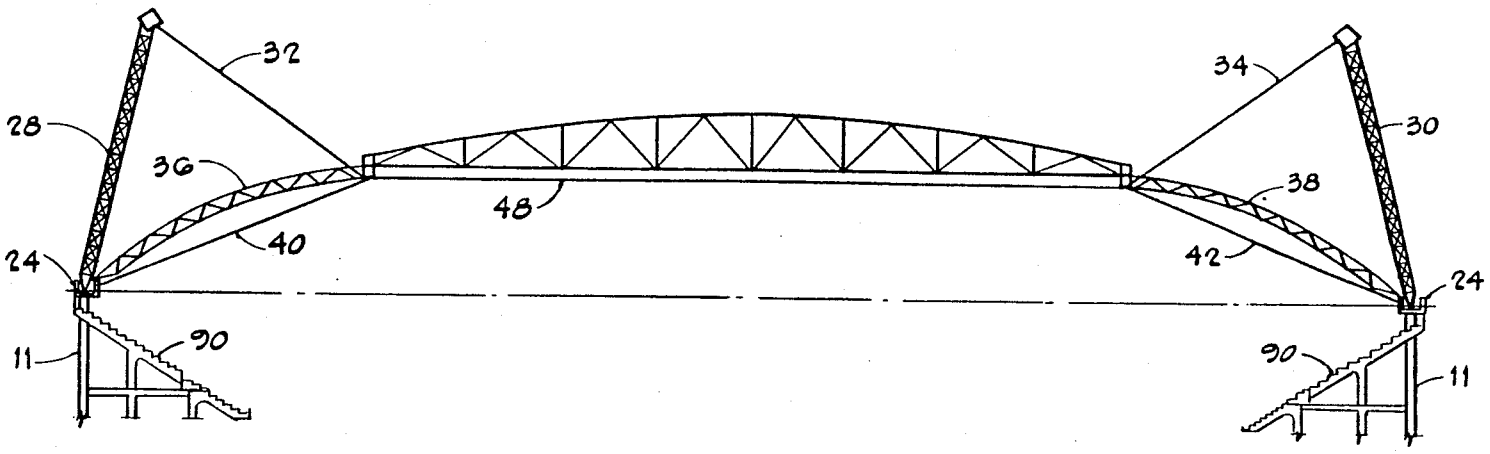
FIG. 5 is a sectional view along a second axis.
Figure 6:
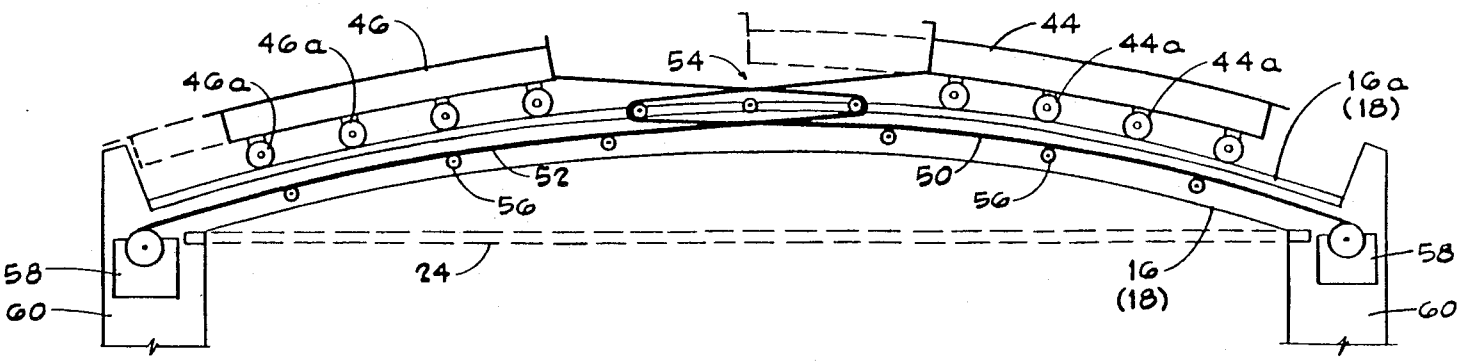
FIG. 6 is a sectional view along a track girder.

A retractable roof structure embodying a first example of the invention covers a stadium field 10, such as a football, soccer or baseball field, and has a first axis 12 and a second axis 14. In the plan view of FIG. 2, track girders 16 and 18 are parallel to each other and to axis 12 and are spaced from each other by a substantial distance, which can be greater than the width of a football field. As best seen in FIGS. 1 and 6, in elevational view along axis 12 each track girder is convex and forms an arc of a circle. Track girders 16 and 18 are suspended from the respective arches 20 and 22 by respective sets of suspension cables 32 and 34, which are arranged in respective triangulated (or parallel) and outwardly inclined patterns, as best seen in FIGS. 1 and 5. Track girders 16 and 18 are stabilized by two respective sets of stabilizing cables 40 and 42, which are anchored to edge ring 24. The horizontal components of forces on the suspension cables and the stabilizing cables are balanced by a set of horizontal tie cables 48. In plan view, as seen in FIG. 2, arches 20 and 22 are convex and circumscribe track girders 16 and 18 such that each track girder is along a chord of the respective arch. In an elevational view along axis 12, as seen in FIG. 4, arches 20 and 22 also are convex, and have curvatures greater than those of track girders 16 and 18 to thereby extend above them. A substantially rigid, laterally extending edge ring 24 in plan view generally (but not necessarily exactly) follows arches 20 and 22 (as seen in FIG. 2) and in elevational view along axis 12 ring 24 extends along chords of the arches and track girder (as seen in FIG. 4). The ends of the arches are supported by abutments 60 which also form the anchor points of track girders 16 and 18 and of edge ring 24. These abutments 60 carry the resultant loads from the components anchored thereon into the foundations. A support, e.g. comprising columns 26, can be used to raise edge ring 24 above grade. Edge ring 24 can be polygonal, or elliptic at the sides of the stadium field and straight at the ends of the field. It need not be a complete ring if elements of the supports for stadium seats 90 are designed to carry the required loads from the roof system. Two sets of substantially rigid struts 28 and 30 extend up from edge ring 24 to the respective arches 20 and 22. Struts 28 and 30 can be in triangulated sets, as illustrated in FIGS. 1–4, or can be in parallel sets. Fixed side roof portions 36 and 38 extend generally laterally from the side portions of edge ring 24 to the respective track girders 16 and 18, and end fixed roof portions 62 and 64 extend from the ends of the roof structure to the rectangular opening for retractable panels 44 and 46. Retractable panels 44 and 46 run on tracks **16*a* and 18*a* of girders 16 and 18 on rollers 44*a* and 46*a*, which in plan view overlap the track, and in elevational view along axis 12 are on rotational centers on loci matching the curvature of the tracks, as best seen in FIG. 6. In elevational view along axis 14, as seen in FIG. 5, roof panels 44 and 46 are convex. Retracting means are provided for selectively moving the roof panels 44 and 46 toward and away from each other along track girders 16 and 18 to thereby close or open the roof of the structure. These means comprise hoist cables 50 and 52 trained over sheave wheels 54 and guide wheels 56 and moved in the desired direction by winch systems 58 housed at abutments 60**, to form a system similar to those used in cable cars and elevators.

Figure 7:
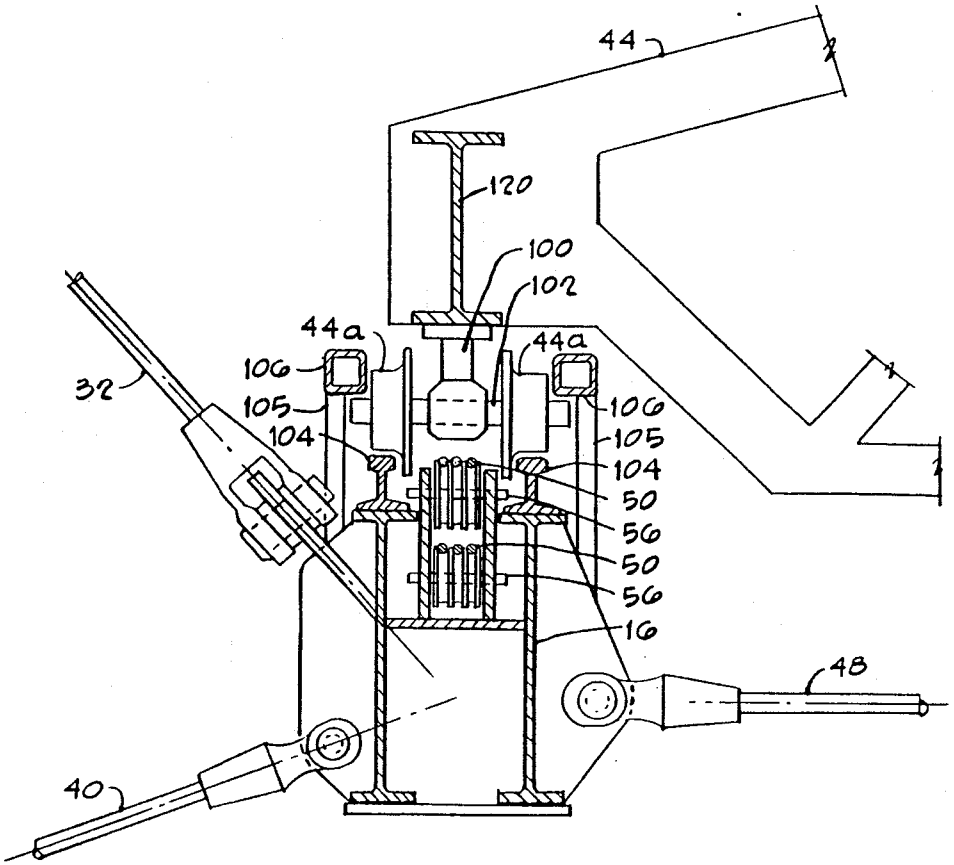
FIG. 7 is a sectional view across a track girder.

FIG. 7 illustrates the retracting system at track girder 16 and roof panel 44, but the same method is used for the other girder and roof panel. Suspended on struts 100 from an edge beam 120 of panel 44 are axles 102 each carrying rollers **44*a* which are similar to railroad wheels and ride on tracks 104 supported on girder 16. Upper tracks 106 are affixed to girder 16 through posts 105 and overlap the outboard ends of axles 102, to prevent lifting of panel 44 under extreme uplift loads. The forward and return runs of hoist cables 56 are carried by guide whels 56. Some relative lateral movement is allowed between panel 44 and girder 16 by allowing strut 100 to ride on axle 102, but its extent is restricted by wheels 44***a*.

Figure 10:
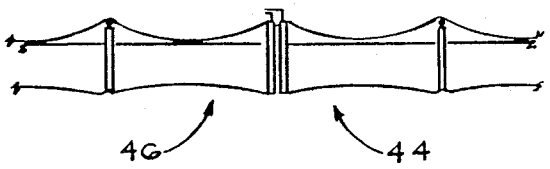
FIG. 10 is a partial sectional view taken at line 10—10 in FIG. 3.
Figure 11:
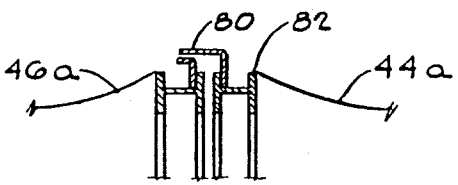
FIG. 11 shows a detail of FIG. 10.
Figure 8:
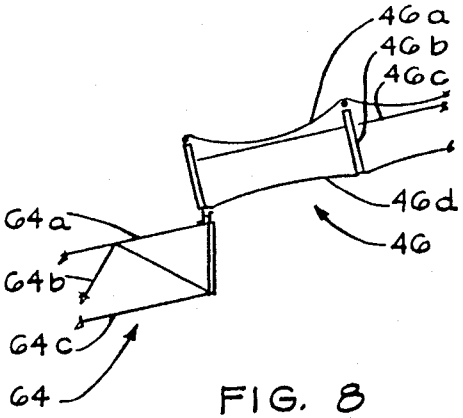
FIG. 8 is a partial sectional view taken at line 8—8 in FIG. 3.
Figure 9:
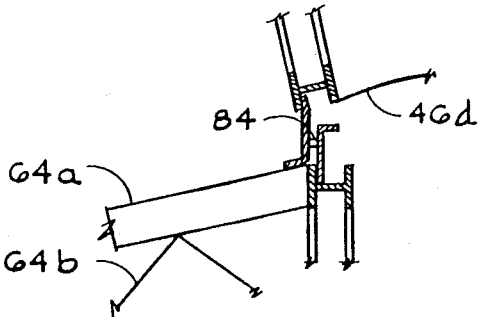
FIG. 9 shows a detail of FIG. 8.

FIG. 8 illustrates the joint between the fixed end roof portion 64 and the retractable panel 46 when in its closed position; the joint between 66 and 44 is similar. Each fixed roof portion can comprise a truss structure, such as the structure of truss memebers 64*b*, and can have roof skin such as at 64*a* and a black-out curtain such as at 64*c*. Similarly, each retractable roof panel can comprise a truss structure of members such as 44*b* and truss members such as 44*c*, covered with roof skin such as 44*a* and if desired using a black-out curtain such as 46*d*. As seen in FIG. 9, the joint can be maintained watertight by ensuring that the edge member of the retractable panel overlaps the fixed roof end portions, for example by using the edge members illustrated in FIG. 9. FIG. 10 illustrates the joint between retractable panels 44 and 46 when they are in their closed positions. As visible in the detail of FIG. 11, a ledge member 80 on panel 44 overlaps the edge member of panel 46, and a compressible rubber tube 82 can be used to complete the seal. A similar tube 84 can be used for the same purpose in the joint illustrated in FIG. 9.

The structure can be erected using generally conventional construction materials and methods. For example suitable foundations are provided and columns 26 and abutments 60 are erected, using reinforced concrete. Edge ring 24 is cast, preferably one segment at a time. Each arch is erected in sections, starting at an abutment 60. For example, starting at one abutment, the two nearest struts 28 are erected on edge ring 24, using structural steel frames, and are joined at a top node and held at the corect inward inclination, for example by temporary bracing cables or struts. A section of an arch steel frame is then assembled and moved into place to span from its anchor point on the abutment to the strut node. The next two struts 28 are then similarly erected and held in place, and another steel frame section of the arch is used to span between the two strut nodes, and so on until the steel frame of an arch is completed. Concrete can then be pumped into forms supported on the steel frame of the arch, using the frame as reinforcing steel. The track girders can be assembled on the ground, preferably in sections, and lifted in position using the completed arches as support points, and the sections affixed to each other to complete the girders and tracks. Tie cables 48 can then be strung and prestressed. The fixed roof portions can be erected using conventional truss techniques. The retractable panels can be assembled on the ground, one truss span at a time, lifted in position by canting them relative to tie cables 48, and the assembly and attachment of roof skin completed in place.

Figure 12:
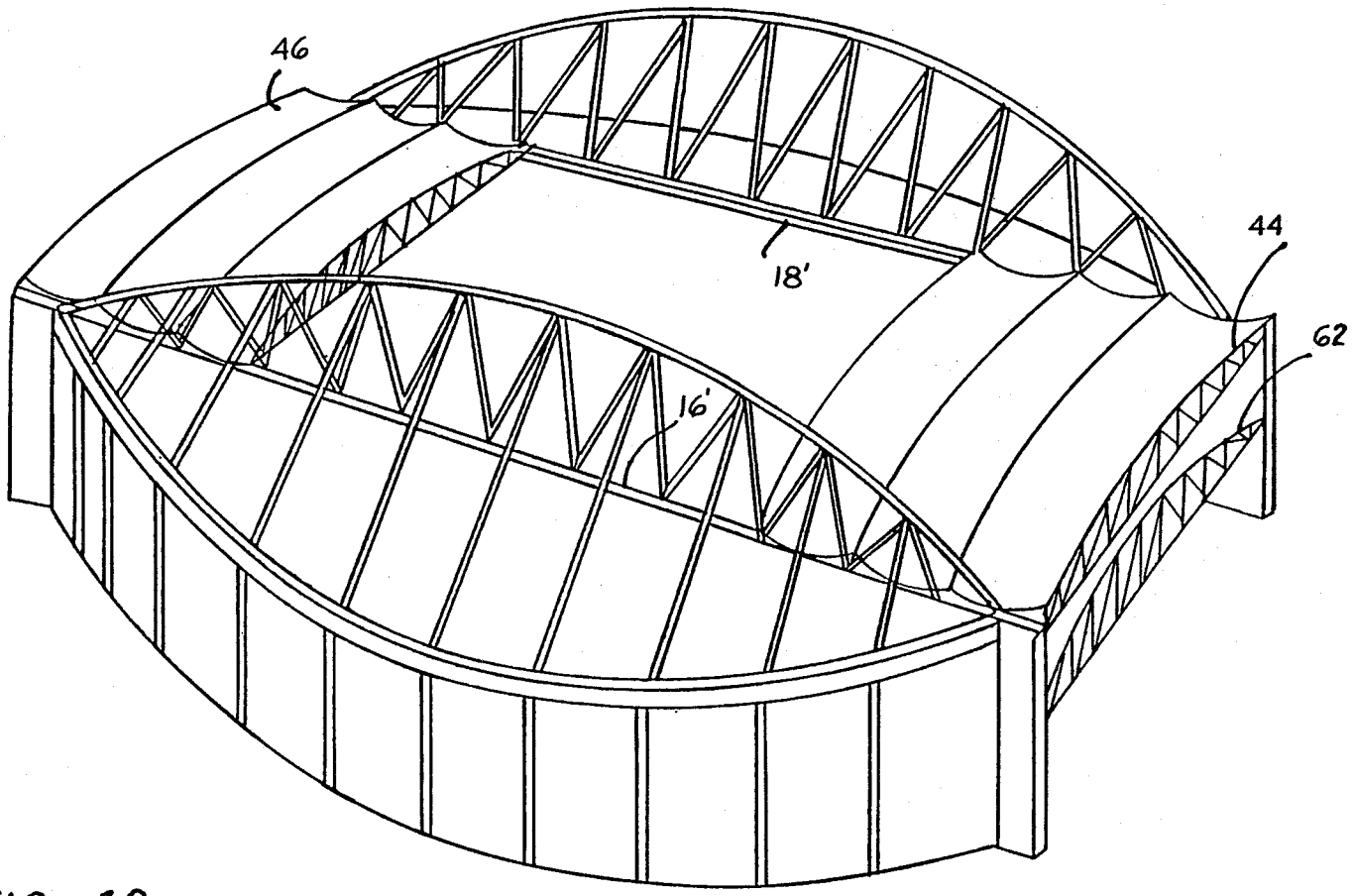
FIG. 12 is a perspective view of a second embodiment of the invention.
Figure 13:
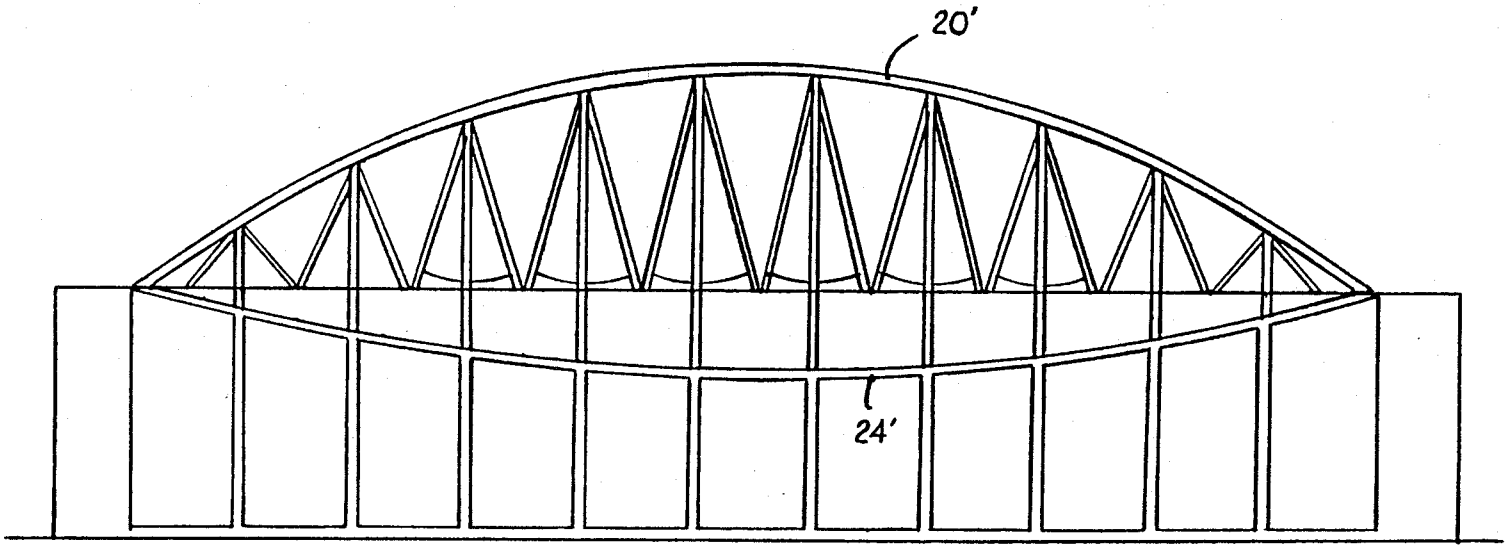
FIG. 13 is an elevational view along a first axis of the second embodiment.
Figure 14:
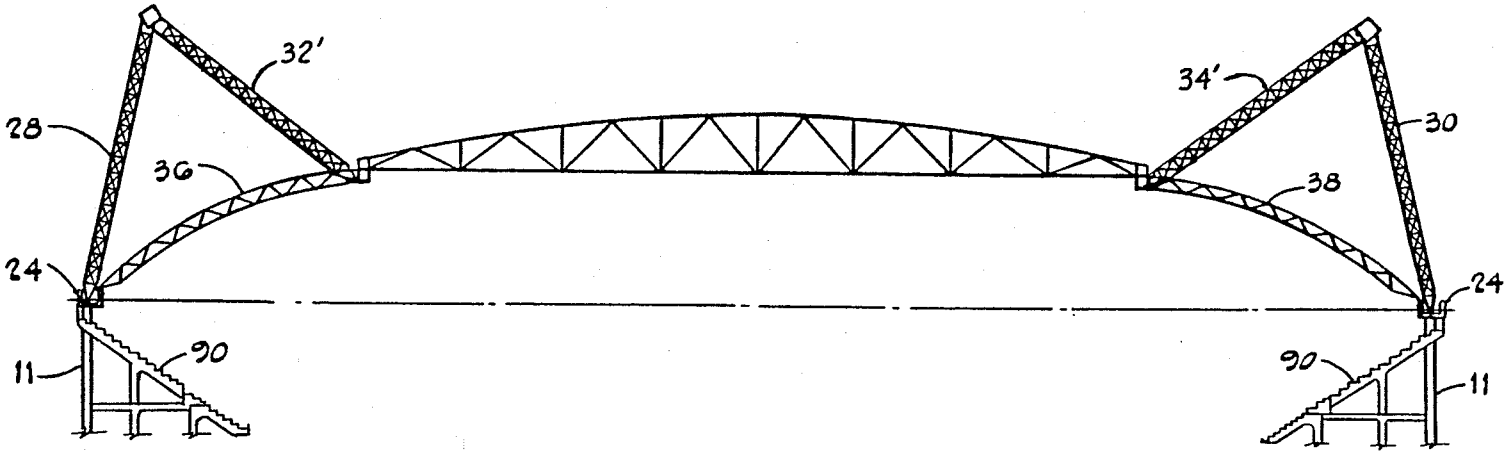
FIG. 14 is a sectional view along a second axis, showing rigid struts in place of cables used in either of the second embodiments.

A second example of the invention is illustrated in FIGS. 12 and 13. It is generally similar to the first example, described in detail above, differing mainly in that it uses straight, horizontal track girders 16' and 18' (and tracks 16*a'* and 18*a'*) in place of the convex track girders 16 and 18 (and tracks 16*a* and 18*a*) in the first example. All other differences flow from this use of straight, horizontal track girders and tracks. Thus, there is no need for hoist cable and associated equipment to move roof panels 44 and 46 along sloping tracks, as in the first embodiment. Since tracks 16*a'* and 18*a'* are horizontal in the second embodiment, motion of retractable roof panels along the tracks can be effected simply by driving at least some of rollers 44*a* and 46*a* by means of electric motors (as schematically illustrated at M in FIG. 7), in the manner used to propel electric train cars by means of synchronized electric motors. Of course, since in this embodiment the tracks are straight and horizontal, fixed roof panels 62 and 64 are identical in any section along a vertical section parallel to axis 12, and similarly retractable roof portions 44 and 46 are identical in the same section. The only other major difference between the first and second embodiments is that the second edge ring is concave in elevation parallel to axis 14 (as seen in FIG. 13), to ensure that it meets arches 20 and 22 at an angle and to ensure that there is adequate slope for water runoff. Note that because track girders 16' and 18' are straight in the second embodiment, they can be used as tie beams for arches 20 and 22, respectively, thereby taking the end loads of the arches and removing the need for abutments 60 and carry these loads to the foundation.

In either embodiment, rigid struts 32' and 34' can be used in place of cables 32 and 34 in the first embodiment, and therefore stabilizing cables 40, 42 and 48 can be omitted in the second embodiment. Rigid struts 32' and 34' can be truss members similar to struts 28 and 30 in the first embodiment. This can make erection of the arch structure easier, as an arch segment can become self supporting when joined to a pair of such rigid struts.

I claim:

1. A retractable roof structure for covering a field having a first axis and a second axis comprising:

two tracks which are parallel to each other and to the first axis;

two arches which in plan view are convex and circumscribe the tracks such that each track is along a chord of a respective arch, and in elevational view along the first axis also are convex and extend above the tracks;

a substantially rigid, laterally extending edge ring which in plan view generally follows the arches;

a support which supports the edge ring above grade;

two sets of substantially rigid arch support struts which extend up from the edge ring to the respective arches;

two sets of track suspending members which extend down from the arches to the respective tracks;

two fixed roof portions which extend from the edge ring to the respective tracks;

two retractable roof panels having runners which in plan view overlap the tracks and match the tracks in elevational view along the first axis, wherein the roof panels are convex in elevational view along the second axis;

means for selectively moving the roof panels toward and away from each other along the tracks to thereby close or open the roof of the structure.

2. A retractable roof structure as in claim 1 in which the tracks are substantially straight and horizontal.

3. A retractable roof structure as in claim 1 in which the track suspending members are substantially rigid truss members.

4. A retractable roof structure as in claim 1 in which the edge ring is concave in at least one elevational view.

* * * * *